United States Patent [19]

Donner

[11] 4,022,109

[45] May 10, 1977

[54] AUTOMATIC DIRECTIONAL CONTROL VALVE

[75] Inventor: Verne P. Donner, Palatine, Ill.

[73] Assignee: Deltrol Corporation, Bellwood, Ill.

[22] Filed: Oct. 1, 1975

[21] Appl. No.: 618,569

Related U.S. Application Data

[63] Continuation of Ser. No. 173,454, Aug. 20, 1971, abandoned.

[52] U.S. Cl. ..... 91/356; 91/318; 91/337; 137/624.27

[51] Int. Cl.[2] ..... F15B 11/15; F01L 25/04

[58] Field of Search ..... 91/356, 318; 137/624.27

[56] References Cited

UNITED STATES PATENTS

| | | | |
|---|---|---|---|
| 2,480,527 | 8/1949 | Wachter | 91/356 |
| 3,145,796 | 8/1964 | Padula | 91/318 |
| 3,738,379 | 6/1973 | Wilke | 137/624.27 |

*Primary Examiner*—Paul E. Maslousky
*Attorney, Agent, or Firm*—John L. Harris

[57] ABSTRACT

A pressure responsive semi-automatic directional control valve for controlling a hydraulic cylinder. Manual movement of the valve from neutral to starting position applies pressure to one side of the cylinder. The pressure buildup at the end of this stroke causes the valve to move to return position. The pressure build up at the end of the return stroke then causes the valve to return to neutral position.

A modification causes movement of the valve back to starting position thus providing continuous repeat cycle operation of the control valve.

10 Claims, 4 Drawing Figures

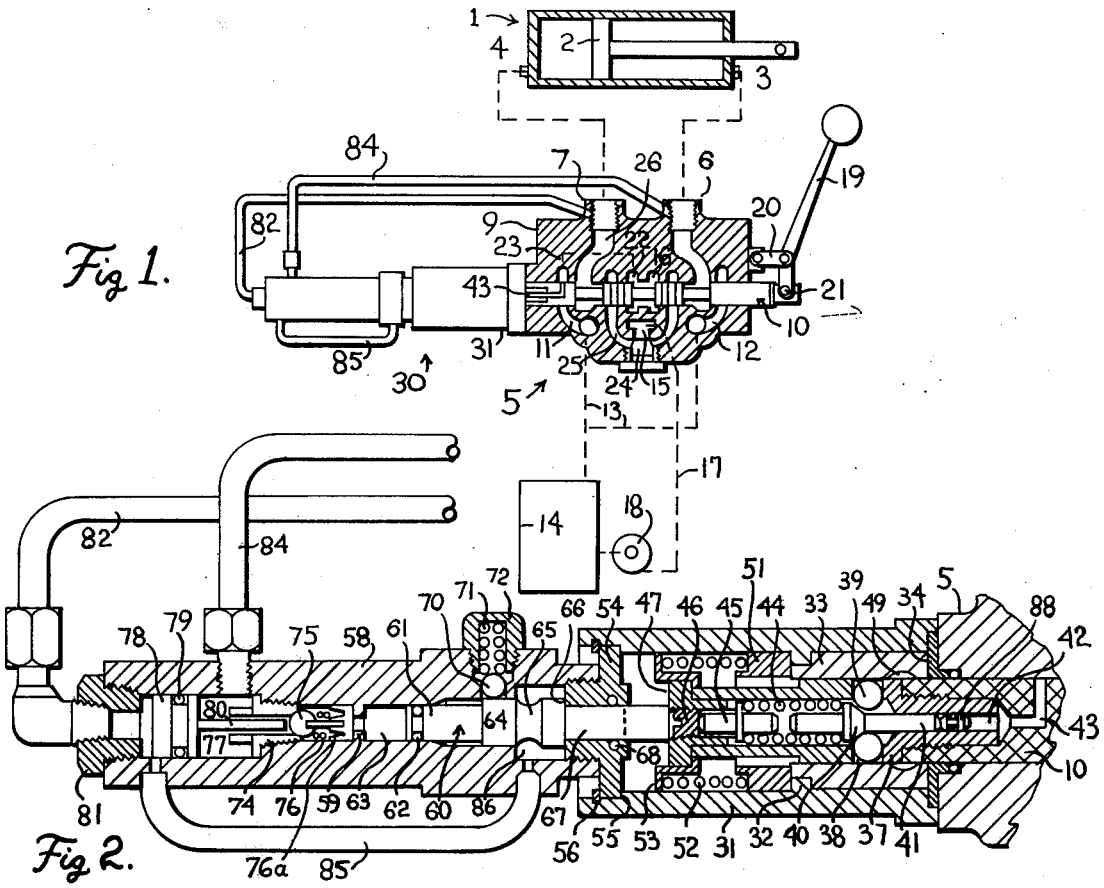
Fig 1.
Fig 2.
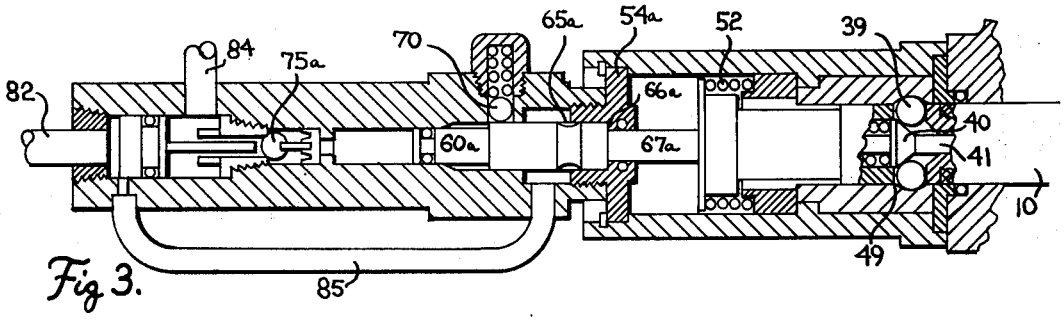
Fig 3.
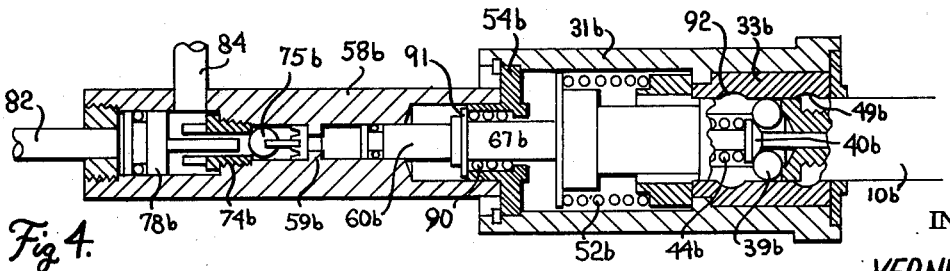
Fig 4.
INVENTOR.
VERNE P. DONNER
BY
John L. Harris
ATTORNEY

AUTOMATIC DIRECTIONAL CONTROL VALVE

CROSS REFERENCE TO RELATED APPLICATION

This application is a continuation of my application Ser. No. 173,454, filed Aug. 20, 1971, abandoned.

BACKGROUND OF THE INVENTION

This invention relates to fluid power operated devices and more particularly to automatic hydraulic cylinder control by directional control valves.

In many applications it is desirable to manually start a hydraulic cylinder cycle and have the system complete the cycle without further attention by the operator. An example is that of a refuse pick-up truck in which refuse is dumped into a hopper and the system activated to compact this material. It is desirable to have the cylinder complete its compacting stroke, return the gate to its retracted position and then return the directional control valve to its neutral position deactivating the hydraulic system.

The Tennis U.S. Pat. No. 2,848,014 discloses a semi-automatic directional control valve in which the valve will move automatically from an active to the neutral position in response to build up in pressure at the hydraulic cylinder. However, use of such a valve on an application as described required two manual operations, one to compact the material and the other to return the gate to open position.

BRIEF SUMMARY OF INVENTION

The primary object of the invention is the provision of a self-contained, automatic directional control valve operating mechanism which is simple and dependable in operation, and rugged in construction.

In the preferred form of the invention, the directional control valve is manually moved against a return spring to starting position, where it is held by a pressure responsive detent. This causes the cylinder to be driven in one direction. When the cylinder meets a predetermined resistance, the resulting buildup in presssure of hydraulic fluid releases the detent allowing the spring to move the valve to cylinder returning position. This drives the cylinder back to its starting position. The hydraulic pressure again builds up and acts on a valve return motor or piston to move the valve to its neutral position, where the piston engages a stop. The piston is now held in this position against the force of the return spring by a check valve trapping hydraulic fluid behind the piston. This check valve is opened and the piston caused to travel to its inactive position when the directional control valve is moved to its starting position. This movement of the piston to inactive position allows the valve to be moved to return position by the return spring.

The invention also includes a continuous repeat cycle valve means for causing the cylinder to drive back and forth continuously. This is achieved by modifying the return piston construction so as to drive the valve back to starting position instead of stopping it at the neutral position.

A further object of the invention is the provision of hydraulic valve operation mechanism which responds to pressure build up at both active positions of the control valve, and causes movement from one active position to the other and back in response to such pressure buildups.

Another object is the provision of drive motor mechanism which moves the valve mechanism to a predetermined position and clears itself to allow reverse movement of the valve mechanism by other means.

A further object of the invention is the provision of a pressure responsive piston motor which is held from initial movement by a biasing means until a predetermined pressure is attained, the biasing force of the biasing means then reducing substantially to allow rapid motion of the piston motor.

Another object of the invention is the provision of a directional control valve which cannot be manually moved in the wrong direction at the start of a cycle.

Other objects will appear from the following detailed description and appended claims.

BRIEF DESCRIPTION OF DRAWINGS

FIG. 1 is a schematic illustration of a hydraulic system controlled by a directional control valve having an operating mechanism embodying the invention;

FIG. 2 is an enlarged sectional view on the control valve operating mechanism providing for semi-automatic operation;

FIG. 3 is a view similar to FIG. 2 of a modification which provides continuous automatic cycling of the valve operating mechanism;

FIG. 4 is a view similar to FIG. 2 of a modification in which the valve operating piston is returned by spring action instead of hydraulic action.

DETAILED DESCRIPTION OF INVENTION

Referring to FIG. 1, reference character to 1 indicates a hydraulic cylinder having a piston 2 and hydraulic fluid ports 3 and 4. A directional control valve generally indicated as 5 includes a port 6 connected by a line 7 with the cylinder port 3. This valve 5 also includes a port 7 which is connected by a line 8 with the cylinder port 4. The directional control valve 5 is of conventional construction well known in the art and includes a valve body 9 receiving a valve spool generally indicated as 10. The valve body includes return passages 11 and 12 which are connected by lines 13 to a fluid reservoir 14. The valve body also includes inlet passages 15 and 16 which are connected by line 17 to pump 18 which pumps hydraulic fluid from the reservoir 14. The valve spool 10 is provided with the usual manual operator consisting of a lever 19 which is pivoted at 20 and connected to the valve spool at 21.

FIG. 1 shows the valve spool in the neutral position. Fluid from pump 18 passes from chambers 15 and 16 directly into chamber 22 from which it passes through passage 23 into the return passage 11 from which it passes back to the reservoir 14.

In order to start a cycle the manual lever 19 is pushed counter-clockwise which pulls the spool 10 to its right-hand power position. This blocks off the connection between passages 16 and 22 and fluid now passes through the load check valve 24 and passageway 25 into the passageway 26, through port 7 to port 4 of the hydraulic cylinder 1. The piston 2 thus moves to the right and hydraulic fluid on its other side will pass through port 3, to port 6 of the valve. As the passage between port 6 and passage 12 is now unblocked by valve 10, fluid is free to flow through a return passage 12 and back to the reservoir 14. Similarly,, when the valve spool 10 is moved to its left hand power position, port 6 is pressurized and port 7 is connected with the reservoir 14 which causes movement of the piston to the left.

When the valve spool 10 has been moved to the right for starting an operating sequence, the remainder of the sequence is performed by the automatic valve operator generally indicated as 30. The mechanism of this operator 30 is shown in detail in FIG. 2. This mechanism includes a cap member 31 which is preferably a machined casting attached to the valve body 5. The cap 31 is hollow and formed with an internal shoulder 32 which serves to locate a sleeve 33 which abuts a spacer 34 at its right hand end. The sleeve 33 is formed with an internal bore receiving the valve spool 10. The end of valve spool 10 is bored out and threaded to receive a detent pin member 37. This detent pin is formed with side openings 38 receiving detent balls 39 which are pressed outwardly by a cone plunger member 40. This member is formed with a shaft-like extension 41 fitting into a bore 42 in the detent pin member 37. This bore 42 communicates with a passageway 43 in the valve spool. As shown in FIG. 1, this passageway extends into the valve body 5. The other side of the cone plunger 40 is formed with a spring guide and receives a spring 44, the other end of which is held by an adjusting pin 45 which is held in place within the detent pin by an adjusting screw 46 carried by a plug 47 which is threadedly attached to the detent pin. It will be apparent that the spring 44 urges the cone plunger 40 to the right thus camming the detent balls outwardly against the inner face of the sleeve 33. The sleeve 33 is formed with an internal detent groove 49 into which the detent balls 39 are pressed when the spool is moved to the right, bringing the balls 39 into registry with the groove 49.

The cap member 31 also carries a spring holder 51 which abuts the internal shoulder 32. This spring holder 51 receives a spring 52, the other end of which is carried by a movable spring holder 53 which fits over the plug 47. It will be apparent that the spring 52 serves to bias the entire spool assembly to the left.

The left-hand end of the cap member 31 is closed by a plug 54 which is locked in place against a shoulder 55 by means of a lock ring 56. The plug 54 is formed with a threaded extension which extension receives a control housing 58 which is bored out from both ends to leave a shoulder 59. To the right of this shoulder 59 is located a piston 60. This piston 60 includes a reduced portion 61 which fits into a reduced diameter bore 63 in the housing 58 and is sealed by means of an O ring 62. The piston 60 also includes a section 64 of larger diameter and formed with a groove 65. The piston also is formed with a shoulder 66 and a reduced diameter section 67 which extends through the plug 54 into contact with the plug 47 carried on the valve spool 10. An O ring 68 serves as a seal between the interiors of cap 31 and housing 58.

The housing 58 is bored out crosswise to receive detent ball 70 which bears against the enlarged portion 64 of the piston 60. This ball 70 is pressed inwardly by means of a spring 71 which is received in a cap 72 threaded into the housing 58. When the piston 60 is moved to the left from the position shown the detent ball 70 will drop into the groove 65 and hold the piston in this position until a force sufficient to overcome spring 71 is applied to the piston.

To the left of the shoulder 59 in housing 58 is located a ball-valve seat 74 which receives a ball valve 75 which is pressed against the seat by a spring 76 carried by guide 76*a* bearing against shoulder 59. Details of this ball check are shown in my U.S. Pat. No. 3,559,678 issued Feb. 2, 1971.

The left end of housing 58 is bored out to provide a chamber 77 receiving a piston 78 provided with an O ring seal 79 and an extension 80 which extends through the ball valve seat 74 into contact with the ball 75. The end of the chamber 77 is provided with a threaded cap 81 which receives a suitable fitting for tube 82. As shown in FIG. 1, this tube 82 extends into the port 7 of the directional control valve. A tube 84 extends from chamber 77 on the right side of the piston 78 to port 6 of the directional control valve. A U tube 85 extends from chamber 77 on the left side of piston 78 into the enlarged chamber 86 surrounding piston 64.

OPERATION OF FIGURE 2

The directional control valve of FIG. 1 and the operating mechanism of FIG. 2 are shown in the positions assumed when the valve is in the neutral position. The valve ports 6 and 7 are blocked off from the source of pressure and a direct passage from the pump 18 back to the fluid reservoir 14 is establlished inside the valve. The piston 60 is now positioned with the shoulder 66 against plug 54 and the extension 67 is in contact with the plug 47. The ball valve 75 is seated and liquid is trapped behind the left end of piston 60 which prevents movement of this piston by the spring 52.

In order to start a cycle, the operator shifts the lever 19 to the left which pulls the valve spool 10 to the right. This pressurizes valve port 7 and connects valve port 6 with the fluid reservoir 14. This same movement of the valve spool to the right caused the detent ball 39 to drop into the detent groove 49, being held in this position by the cone plunger 40 which is pressed to the right by the spring 44. During this movement of the valve spool 10 to the right, the spring 52 is compressed additionally but the detent mechanism holds the spool in position against the force of the spring thus allowing release of the handle 19.

Pressure now builds up into valve port 17 causing the piston 2 to move to the right. This same pressure is applied through tube 82 to the back of piston 78 causing this piston to move to the right and move the ball check 75 away from seat 74. The same pressure is also applied through tube 85 to the chamber 86 surrounding the piston 60. This pressure is exerted on the shoulder 66 of the piston, causing it to move to the left, pushing the previously trapped hydraulic fluid past the now opened check valve seat through tube 84 into the valve port 6 from which it passes to the fluid reservoir 14. Natural irregularities of abutting surfaces 66–67 allow fluid to flow behind shoulder 66 to initiate the movement described. The piston 60 will continue its movement to the left until stopped by the shoulder 59. This movement of the piston retracts the piston rod 67 from the plug 47 on spool 10. The end of this piston rod now assumes the position shown in dotted lines and the piston is held in this position by detent ball 70 being forced into the detent groove 65 by the spring 71.

When the valve spool was moved to the right, the passageway 43 was brought into registry with the valve chamber 26 communicating with port 7. Thus the same fluid pressure applied to the hydraulic cylinder port 4 is also applied through passage 43 to a piston 88 in the detent pin passageway 42. When this pressure reaches a predetermined value, the force on piston 88 overcomes the spring 44 causing movement of the cone plunger to the left, releasing detent balls 39. The spring 52 now shifts the entire spool assembly to the left until the spring holder 53 strikes the plug 54. This movement takes the spool through the neutral position to the left-hand power position in which valve port 6 is pressurized and the valve port 7 connected to the fluid reservoir. This applies pressure to the port 3 of the hydraulic motor and fluid from the port 4 passes through the valve back the reservoir. Fluid under pressure from port 6 also passes through the tube 84 and the ball check valve into the chamber 63 behind piston 60. Movement of this piston is initially restrained by the detent ball 72 being forced into the groove 65 by spring 71. When the piston 2 of the fluid motor reaches the left hand end of the stroke, the pressure developed by the pump 18 increases, thus increasing the force on piston 60. When this pressure reaches a predetermined value, the camming action of groove 65 on ball 70 overcomes the spring 71. The holding force on the detent ball 70 now decreases rapidly and the piston moves rapidly to the right, first taking up the space between shaft 67 and plug 47, and then moving the entire valve spool assembly to the right against the action of the spring 52. This movement will continue until the shoulder 66 on the piston engages plug 54 which serves as a stop. This causes the valve to stop in the neutral position.

The piston 60 is now held in this position due to the fluid from tube 84 being trapped behind it by the check valve means. The pressure from tube 84 in addition to affecting piston 60 also caused the piston 78 to move to the left for permitting the ball check 75 to seat.

From the foregoing it will be apparent that upon movement of the manual lever to starting position, the valve spool applies pressure to the port 4 of a hydraulic motor and is locked in this position by the detent ball 39. This same pressure is also applied through tubes 82 and 85 causing release of the liquid trapping means and movement of the return piston 60 out of the path of the spool valve assembly in moving to its lefthand power position. Upon the build-up in fluid pressure resulting from the hydraulic cylinder reaching the end of its stroke the pressure responsive means releases the detent balls 39 which allows the spring 52 to move the spool assembly to its lefthand power position. At this time fluid pressure is applied to port 3 of the motor and this same pressure is applied through tube 84 urging the piston 60 to the right. This piston and the detent mechanism serve as a pressure responsive means preventing moving of the piston until a predetermined pressure is attained due to pressure build-up occurring when the hydraulic motor reaches the other end of its stroke. When this pressure is attained, the detent mechanism releases the piston which moves the spool assembly back to the neutral position. Thus the return of the spool valve assembly is achieved by hydraulic motor means in response to attainment of a predetermined pressure. The spool valve assembly is also maintained in the neutral position due to entrapment of hydraulic fluid behind the piston by the valve means 75. It should be noted that due to the entrapment of hydraulic fluid behind the piston 60 when the valve is in the neutral position, the valve cannot be manually moved from the neutral position to its left-hand power postion. This prevents the operator from moving the handle 19 in the wrong direction when starting an operating cycle for the hydraulic motor 1. In order to get the valve into the left-hand power position, it is necessary first to move it to the right-hand power position which releases the holding means normally preventing movement of the valve it its left-hand power position.

FIG. 3

FIG. 3 is the same construction shown as FIG. 2 with the exception of a change in proportion of the valve return piston and the space in which it operates. In this embodiment of the invention, the plug **54*a* is relieved so that when the shoulder 66*a* of piston 60*a* engages it, the shaft section 67*a* has pushed the spool valve assembly beyond the neutral position into the right-hand power position. The detent balls 39 are thus in groove 49 and will hold the spool assembly in this position until a pressure build-up occurs. FIG. 3 shows the parts in the positions assumed when the spool has just been moved to its right-hand power position and before a pressure applied at valve port 7 has reached the far end of tube 82. When this occurs, this pressure opens the ball check 75*a* and acts on shoulder 66*a* of the piston to return it to its left-hand position where it is locked by the detent ball 70 into groove 65*a*. When the hydraulic cylinder reaches the end of its stroke, the pressure build-up at valve port 7 releases the cone plunger 40 permitting the spring 52 to move the spool assembly to its left-hand power position. This causes movement of the hydraulic cylinder in the opposite direction and also applies fluid pressure through the check valve 75 to the left end of piston 60*a*. When the cylinder reaches the other end of its stroke the resulting pressure build-up becomes sufficient to move the piston 60*a* overcoming detent ball 70. The holding force of the detent ball rapidly disappears allowing rapid movement of piston 60*a* which returns the valve spool 10 to its right-hand power position. As the valve spools move into its neutral position, passage of hydraulic fluid through tube 84 is cut off. However, the piston 60*a*** continues its travel due to inertia and the expanding action of the hydraulic fluid due to entrapped air.

From the foregoing it will be apparent that in this embodiment of the invention, the control valve will cycle indefinitely, causing the hydraulic cylinder to move from one end of its stroke to the other and back again continuously as long as fluid power is supplied by the pump 18.

FIG. 4

FIG. 4 shows a modified form of the invention in which the piston **60*b* is returned to its inactive (left-hand) position by means of a spring 90 instead of by hydraulic action. The spring 90 surrounds the extension 67*b* of the piston inside of the plug 54*b*. One end of this spring bears on the plug 54*b* and the other end on a shoulder 91 on piston 60*b*. The spring 90 thus urges the piston 60*b* toward its left-hand position against shoulder 59*b* formed in housing 58*b*. In the embodyment of FIG. 4, the separate detent ball 70 is omitted and the holding of the valve spool in its left-hand position is achieved by a groove 92 in sleeve 33*b*. When the valve spool is moved in its left-hand power position, the detent balls 39*b* are forced into groove 92 by the spring 44*b* bearing on the cone plunger 40*b*. FIG. 4 shows the parts in the position assumed when the valve spool is in the neutral position. The detent balls 39*b* are midway between the detent grooves 92 and 49*b*. The piston 60*b* is holding the spool assembly against the biasing force of spring 52*b*** due to hydraulic fluid being trapped behind the piston by the ball check 75*b*.

When the operator moves the valve spool to its right-hand position, balls 39*b* are forced into groove 49*b* thus holding the spool in this position against the action of spring 52*b*. The valve port 7 is pressurized causing movement of a hydraulic motor 1 and also applying pressure through tube 82 to the left side of piston 78*b* which opens ball check 75*b*. The spring 90 is now free to force the piston 60*b* to its inactive position, the trapped hydraulic fluid now passing through the ball check and tube 84 to the now exhausting valve port 6. When the hydraulic motor 1 reaches the end of its stroke, pressure builds up at valve port 7 causing release of the detent balls 39 by the cone plunger 40*b*. The spring 52*b* now moves the spool assembly to the left and the detent balls 39 are forced into the detent groove 92. Valve port 6 is now pressurized and port 7 exhausts, this causing movement of the fluid motor to its other position. When this occurs, the pressure applied through tube 84 builds up to the point where the force on piston 60*b* overcomes the holding action of the detent balls 39*b* in groove 92. This holding force now rapidly disappears and piston 60*b* moves to the right until its shoulder 91 engages the plug 54*b*. This returns the valve spool to the neutral position as shown.

From the foregoing it will be apparent the present invention provides for either semi-automatic operation or continuous repeat automatic operation of a directional control valve. This operation insures movement of a hydraulic cylinder either through its complete stroke or until it encounters a predetermined resistance. When either occurs the valve automatically shifts to provide the desired control cycle. It will be further apparent that these results are achieved by a fully self-contained hydraulic mechanism and requires no external control components.

As many modifications may be made from the preferred embodiments disclosed without departing from the spirit and scope of the invention, it is desired to be limited only by the scope of the appended claims.

I CLAIM:

1. In a control system for a fluid power operated device, the combination of, valve means arranged to control application of fluid pressure to said device, said valve means having a first control position and a second control position, said positions having different effects on the fluid power operated device, means for causing movement of the valve means from its first position to its second position, and fluid pressure actuated means responsive to a pressure change when the valve means is in its second position for driving the valve means from said second position, said last named means comprising a fluid pressure operated motor arranged to apply the motive force for moving the valve means, yieldable detent means restraining initial movement of the pressure operated motor for preventing movement of the motor until a predetermined pressure is attained, said yieldable detent means being constructed and arranged to reduce its restraining force after yielding.

2. In a control system for a fluid power operated device, the combination of, valve means arranged to control application of fluid pressure to said device, said valve means having a first control position and a second control position, said positions having different effects on the fluid power operated device, means for causing movement of the valve means from its first position to its second position, and fluid pressure actuated means responsive to a pressure change when the valve means is in its second position for driving the valve means from said second position, said last named means comprising a piston arranged to apply the motive force for moving the valve means, means for applying fluid pressure to one side of the piston when the valve means is in its second position for causing movement of the valve means from the second position, and means for applying fluid pressure to the other side of the piston when the valve means is in its first position.

3. In a control system for a fluid power operated device, the combination of, valve means arranged to control application of fluid pressure to said device, said valve means having a first control position and a second control position, said positions having different effects on the fluid power operated device, means for causing movement of the valve means from its first position to its second position, and fluid pressure actuated means responsive to pressure change when the valve means is in its second position for driving the valve means from said second position, said last named means comprising a piston arranged to apply the motive force for moving the valve means, said piston receiving fluid pressure as a result of the valve means being in its second position, said means for moving the valve means to its second position including a spring which is compressed by the piston on moving the valve means away from said second position, holding means for trapping fluid behind the piston, and means for releasing said holding means when the valve means is in its first position.

4. In a control system for a fluid power operated device, the combination of, valve means arranged to control application of fluid pressure to said device, said valve means having a first control position and a second control position, said positions having different effects on the fluid power operated device, means for causing movement of the valve means from its first position to its second position, and fluid pressure actuated means responsive to a pressure change when the valve means is in its second position for driving the valve means from said second position, said last named means comprising a piston arranged to apply the motive force for moving the valve means, said piston receiving fluid pressure as a result of the valve means being in its second postion, and means for returning the piston to an inactive position prior to movement of the valve means to its second position, said last named means being pressure actuated as a result of the valve means being in its first position.

5. In a control system for a fluid power operated system including a source of fluid pressure and a reversible fluid power operated device having a first port in which application of fluid pressure causes movement of the device in one direction and a second port in which application of fluid pressure causes movement in a second direction, directional control valve means for controlling the application of fluid pressure to said ports, said directional control valve means having a first position in which it connects the first port to the source of pressure, a second position in which it connects the second port to the source of pressure and a neutral position in which both ports are blocked from the source of pressure, the neutral position being between the first and second positions, means including a spring means for biasing the valve means toward its second position and arranged to move the valve means to its second position when released, means for moving the valve means from the neutral position to its first position and compressing said spring means, holding means for holding the spring means compressed to maintain the valve means in its first position, means for releasing said holding means in response to pressure build-up at said first port, the spring means moving the valve means through the neutral position to said second position, thereby automatically applying pressure to the second port, means including a piston for moving the valve means to the neutral position, control means for aplying pressure to the piston and causing movement thereof for moving the directional control valve means to its neutral position in response to build-up of pressure at said second port, said control means being constructed and arranged to cause movement of the piston in the opposite direction when the valve means is in its first position, and means for holding the valve meansin the neutral position against the action of the spring means.

6. In a control system for a fluid power operated system including a source of fluid pressure and a reversible fluid power operated device having a first port in which application of fluid pressure causes movement of the device in one direction and a second port in which application of fluid pressure causes movement in a second direction, directional control valve means for controlling the application of fluid pressure to said ports, said directional control valve means having a first position in which it connects the first port to the source of pressure, a second position in which it connects the second port to the source of pressure and a neutral position in which both ports are blocked from the source of pressure, the neutral position being between the first and second positions, means including a spring means for biasing the valve means toward its second position and arranged to move the valve means to its second position when released, means for moving the valve means from the neutral position to its first position and compressing said spring means, holding means for holding the spring means compressed to maintain the valve means in its first postion, means for releasing said holding means in response to pressure build-up at said first port, the spring means moving the valve means through the neutral position to said second position, thereby automatically applying pressure to the second port, means including a piston for moving the valve means to the neutral position, and means for holding the valve means in the neutral position, said last named means including a check valve trapping fluid behind the piston.

7. The combination set forth in claim 6 in which the check valve is released by fluid pressure applied as a result of the valve means being moved to its first position.

8. The combination set forth in claim 6 in which fluid pressure is applied to the opposite side of the piston when the valve is in its first position for causing the piston to return to its original position prior to releasing the holding means.

9. In a control system for a fluid power operated system including a source of fluid pressure and a reversible fluid pressure operated device, a three position directional control valve means having a manual operating handle, said valve means having a neutral position, a return position and a start position, means for preventing improper manipulation of said handle, said last mentioned means including locking means for preventing initial manual movement of the valve means from the neutral position to the return position, and means normally actuated substantially immediately on movement of the valve means from the neutral position to the start position for releasing the locking means to permit movement of the valve means to the return position, said actuated means comprising release means for releasing the locking means and means normally actuated substantially immediately on movement of the valve means from the neutral position for initiating operation of the release means.

10. In a control system for a fluid power operated system including a source of fluid pressure and a reversible fluid pressure operated device, means including a three position directional control valve having a manual operating handle arranged to control said device, said valve means having a neutral position, a return position and a start position, pressure responsive means responsive to a pressure buildup to a predetermined pressure when the valve means is in the start position for moving the valve means away from the start position, and means for preventing improper manipulation of the handle, said last mentioned means including locking means for preventing initial manual movement of the valve means from the neutral position to the return position, and releasing means actuated on movement of the valve means from the neutral position to the start position for releasing the locking means to permit movement of the valve means to the return position, said releasing means being constructed and arranged to release the locking means independently of said pressure responsive means and before the buildup to said predetermined pressure.

* * * * *